United States Patent [19]

Walters

[11] 3,976,345

[45] Aug. 24, 1976

[54] DEPOSITORY

[75] Inventor: Russell W. Walters, Richmond, Ky.

[73] Assignee: BMR Security Products Corporation, Richmond, Ky.

[22] Filed: Jan. 14, 1975

[21] Appl. No.: 540,825

Related U.S. Application Data

[63] Continuation of Ser. No. 311,474, Dec. 4, 1972, abandoned.

[52] U.S. Cl. ..... 312/333; 232/43.2; 232/47; 312/100; 312/215

[51] Int. Cl.[2] ..... B65D 91/00

[58] Field of Search ..... 232/15–17, 232/31, 32, 43.2, 44, 47, 48, 43.1, 51, 53, 54, 55; 109/56, 59, 68, 77; 312/100, 346, 347, 215, 333; 70/371, 90, 361

[56] References Cited

UNITED STATES PATENTS

| | | | |
|---|---|---|---|
| 726,821 | 4/1903 | Lambert | 232/31 |
| 778,424 | 12/1904 | Mosher | 232/55 |
| 1,776,404 | 9/1930 | Wetzel | 312/346 X |
| 2,116,306 | 5/1938 | Dziembowski | 232/43.2 X |
| 2,238,004 | 4/1941 | Wolters | 312/348 X |
| 3,039,835 | 6/1962 | Liedeker, Jr. | 312/100 |
| 3,071,958 | 1/1963 | Russo | 70/361 X |
| 3,565,504 | 2/1971 | Brown | 312/351 X |
| 3,711,894 | 1/1973 | Walters | 70/371 X |

FOREIGN PATENTS OR APPLICATIONS

| | | | |
|---|---|---|---|
| 62,548 | 10/1912 | Switzerland | 232/47 |
| 374,614 | 6/1932 | United Kingdom | 70/371 |

*Primary Examiner*—Roy D. Frazier
*Assistant Examiner*—William E. Lyddane
*Attorney, Agent, or Firm*—Allan Ratner

[57] ABSTRACT

A depository to permit insertion and storage of articles as well as to protect the inserted articles from unauthorized removal. The depository includes a chest structure defining an interior chamber with closing means to prevent external access and secured to the outer face of the closing means is a lock enclosure housing having a through passage aligned with the bore of a bar member secured to the chest. A bar lock is movable within the passage and insertable into that bore. A portion of the closing means extends external to the outer face thereof and provides at least a partial cover for the lock enclosure housing.

8 Claims, 10 Drawing Figures

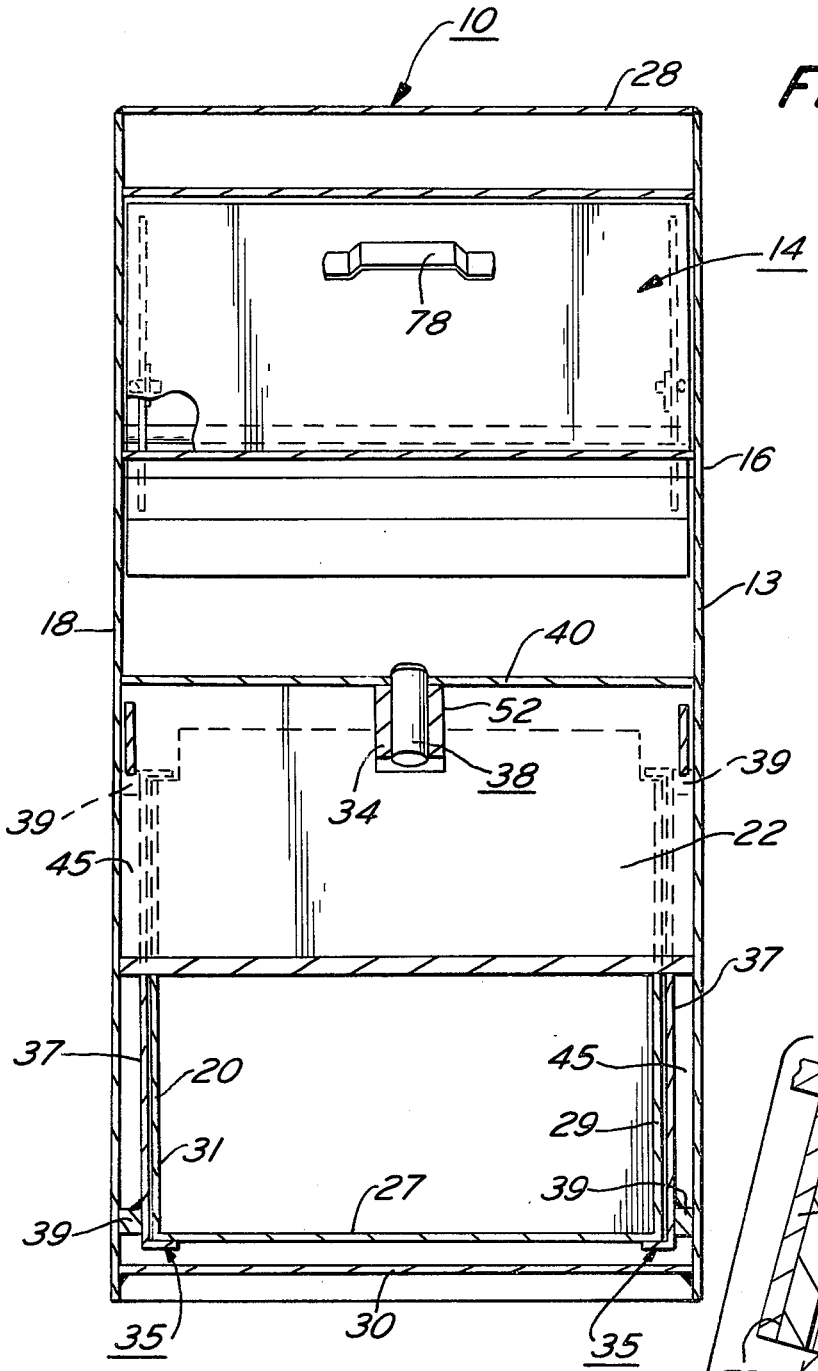
FIG. 3
FIG. 5
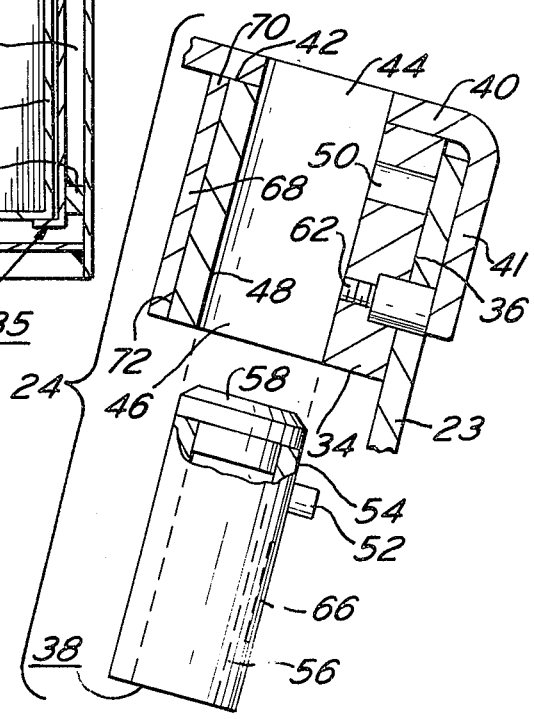

FIG. 6
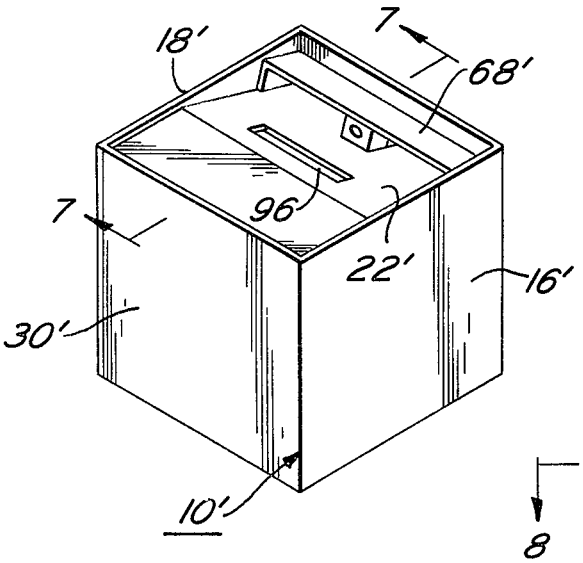
FIG. 10
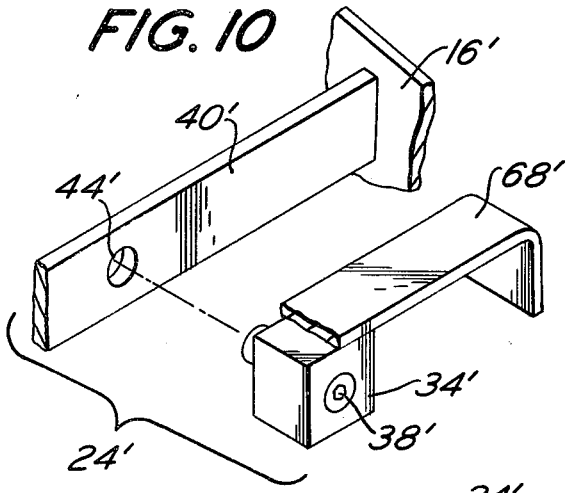
FIG. 7
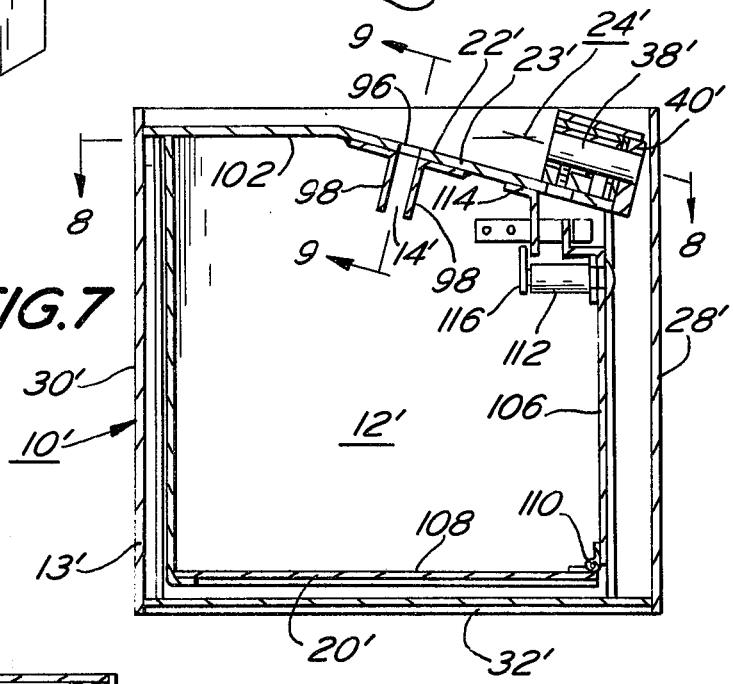
FIG. 8
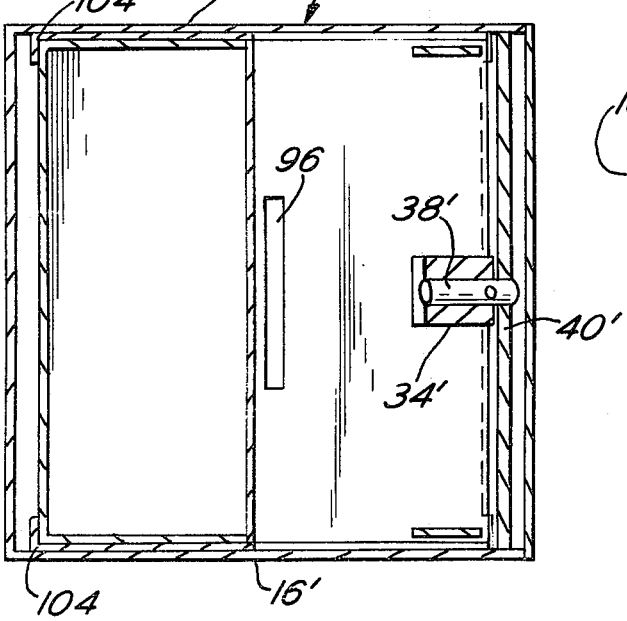
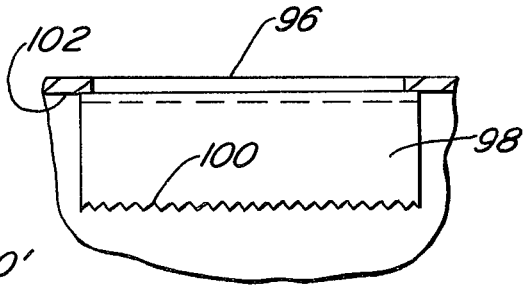
FIG. 9

DEPOSITORY

This is a continuation of application Ser. No. 311,474 filed Dec. 4, 1972 now abandoned.

BACKGROUND OF THE INVENTION

1. Field of the Invention

This invention relates to the field of depositories.

2. Prior Art

Some prior depositories provide drawer locking mechanisms located within the depository handles. In such locking mechanisms, a torqueing force applied to the handle can remove both the handle and lock from the depository thereby allowing the drawer to be opened.

In other prior depositories, the drawer locking mechanisms are mounted on the front side or back of the depository structure. Such locking mechanisms can then be attacked at the interface of the lock mechanism and the depository structure or at the interface betwen the lock and the drawer.

Mechanisms to permit insertion of articles into a drawer within a depository without unlocking it are also known in the art. However, some of these mechanisms do not have any means for blocking articles contained within the drawer. This may lead to unauthorized removal of objects stored in the drawer. While some mechanisms act in cooperation with electrically operated blocking devices, such mechanisms are dependent on an electrical power supply. If the supply is cut off or extremely tampered with, the blocking device may hold the article and easily permit its theft.

Some other article insertion mechanisms are broken into compartments in order to block the path to the drawer when the insertion mechanism is positioned to receive articles. However, such mechanisms are restricted in the quantity and size of the article being received.

SUMMARY OF THE INVENTION

A depository comprising a chest defining an interior chamber and means for closing the interior chamber to prevent external access to objects deposited for safekeeping in the internal chamber. A bar member is secured to the chest with the bar member having a single bore. A lock enclosure housing is rigidly secured to an outer face of the closing means with the housing having a single through passage aligned with the single bore of the bar member. The bar lock is movable within that passage with a lock pin insertable into a recess formed in the passage when the bar lock is inserted into the bore of the bar member. The bar lock is only movable within the single through passage and the single bore. A portion of the closing means extends external to the outer face of the closing means and provides at least a partial cover for the lock enclosure housing.

BRIEF DESCRIPTION OF THE DRAWINGS

FIG. 3 is a cross-sectional view of the depository taken along the section line 3—3 of FIG. 2;

FIG. 5 is an exploded cross-sectional view of the releasable securement mechanism;

FIG. 6 is a perspective view of an embodiment of the invention showing a depository;

FIG. 7 is a cross-sectional view of the depository embodiment taken along the section line 7—7 of FIG. 6;

FIG. 8 is a cross-sectional view of the depository taken along the section line 8—8 of FIG. 7;

FIG. 9 is an elevational veiw of an appendage forming a portion of the inserting mechanism of the invention embodiment; and, FIG. 10 is a perspective view of the securement mechanism for the invention embodiment.

DESCRIPTION OF THE PREFERRED EMBODIMENTS

Figure 1:
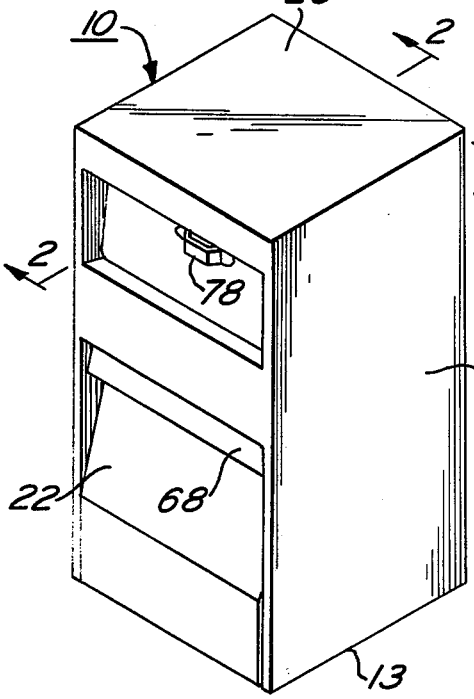
FIG. 1 is a perspective view of the depository.
Figure 2:
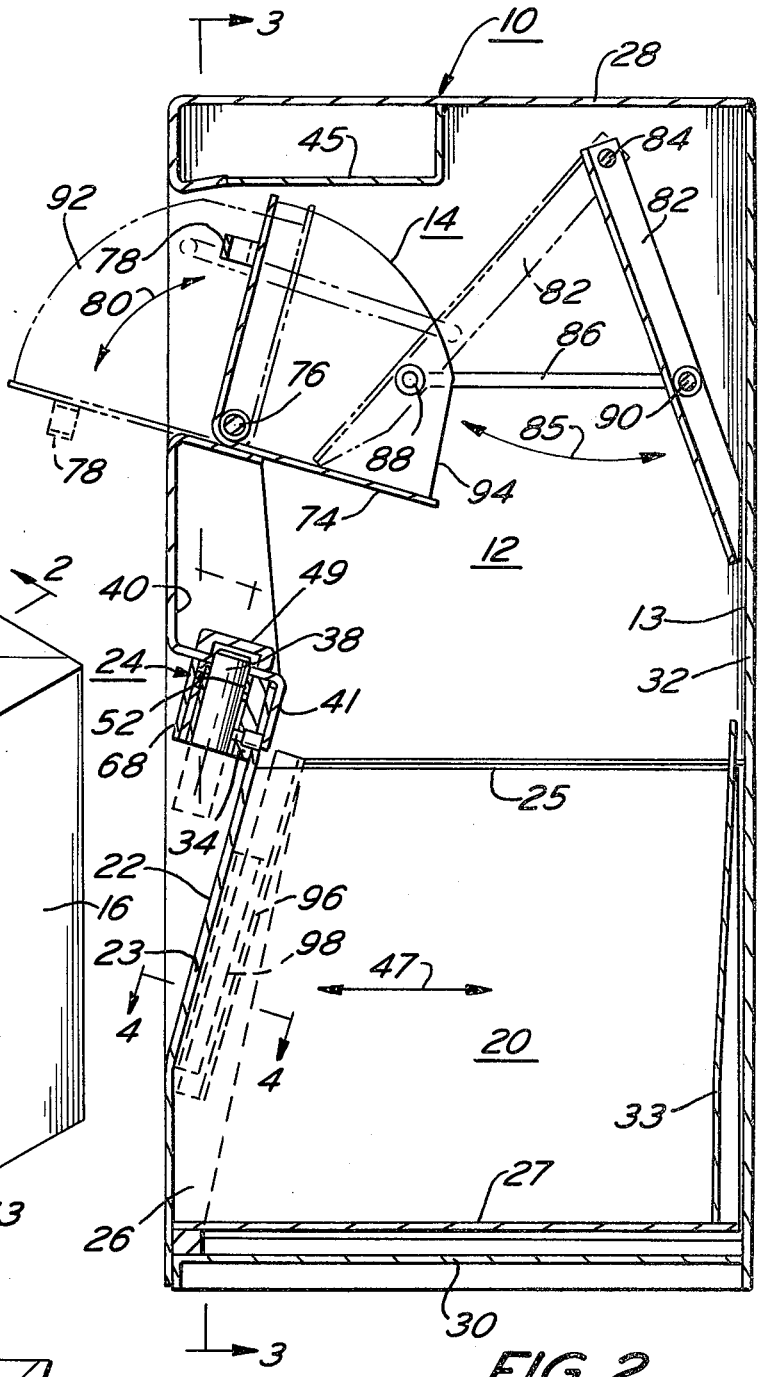
FIG. 2 is a cross-sectional view of the depository showing the releasable securement mechanism and the inserting mechanism, taken along the section line 2—2 of FIG. 1.

Referring now to FIGS. 1, 2 and 3 there is shown depository or vault 10 to permit insertion and retention of objects incorporated therein as well as to protect the inserted objects from unauthorized removal. Depository 10 has as its main purpose to provide an object receptacle which is substantially impervious to external surreptitious manipulation. Depository or vault system 10, as hereinafter described, also includes a mechanism which protects objects already contained therein from removal when depository 10 is partially opened for the insertion of a new set of objects.

Depository 10 comprises insertion mechanism 14 which permits insertion of objects into interior chamber 12 defined by the surrounding enclosure or chest 13. Mechanism 14 is movably secured to opposing depository sidewalls 16, 18. An open position of mechanism 14 permits acceptance of objects or articles to be inserted and a closed position provides for transmittal of the articles into drawer mechanism 20. Drawer mechanism 20 is positionally located in a lower portion of internal chamber 12 of depository 10 and receives the articles transmitted thereto through inserting mechanism 14. Releasable securement mechanism 24 is securely fastened to outer face 22 of drawer frontal panel 23 and provides partial release of drawer mechanism 20 from constrained relation within chest 13. In this manner, by unlocking or otherwise releasing securement mechanism 24, drawer 20 may be linearly removed through depository frontal portion 26 in order to permit retrieval of objects or articles stored within drawer 20.

Depository or vault 10 is formed into a box-like structue as shown clearly in FIGS. 1 and 2. The box structure or chest 13 includes ceiling and floor members 28, 30 being vertically displaced each from the other in substantially parallel fashion. Chest back or rear wall 32 is contiguous with and secured along its periphery to ceiling 28, floor 30, and opposing walls 16, 18. Depository frontal portion 26 serves to permit incorporation of articles through mechanism 14 mounted thereon as well as providing a mechanism whereby drawer 20 may be partially removed from interior chamber 12. The structure composition of the components of chest 13 may be of high grade steel or some like material having structural integrity sufficient to prevent fracture or other structural degradation when attacked by unauthorized personnel or when subjected to extreme environmental conditions.

Drawer 20 is a receptacle for articles transmitted thereto from inserting mechanism 14. Articles fall into drawer 20 by gravity assist through upper open portion 25 and subsequently fall to drawer floor member 27. Opposing drawer sidewalls 29, 31 are contiguously mated to floor 27, frontal panel 23 and drawer rear wall 33 as is shown in FIGS. 2 and 3. Drawer 20 is linearly movable with respect to chest 13 along guide mechanism 35 as is shown in FIG. 3. Transversely displaced track members 37 having a geometrical right angle contour extend from the frontal portion of chest 13 to the rear portion providing a track guide over the entire length of drawer 20. Track members 37 are secured on sidewalls thereof to spacer blocks 39 which in turn are fastened to opposing depository sidewalls 16, 18. Drawer floor 27 rests on an interior upper surface of track member 37 and is slideably movable with respect thereto. Spacer blocks 39 may be welded or otherwise fastened to opposing sidewalls 16, 18 and track members 37 to maintain members 37 in fixed positional relationship with respect to drawer mechanism 20. Each of track members 37 is generally U-shaped as shown in FIG. 3 to provide guidance for drawer 20 when it is moved in a longitudinal direction defined by directional arrow 47. In this manner, there is seen to be created a pair of open channels 45 between opposing walls 16, 18 and respective track members 37. This particular type construction provides an anti-pry system whereby when a lever is forced into channel 45 and a torqueing force is applied, such force is only transmitted to drawer 20 in a direction substantially normal to arrow 47 and not in a direction such that drawer 20 would be forced out of chamber 12.

Releasable securement mechanism 24 is clearly shown in FIGS. 2, 3 and 5 and provides a means whereby drawer 20 may be constrained within chest 13. Securement mechanism 24 includes lock enclosure member 34 which is box-like in structure and is securely mounted to drawer outer face or surface of drawer frontal panel 23. Enclosure member 34 is secured to frontal panel 23 along interface surface 36 through welding, bolting or some ike means such that member 34 is securely fastened to drawer panel 23 and consequently to the entire structure of drawer 20. Member 34 on an upper surface thereof is contiguous with bar member 40 along interfacing surface 42 as shown in FIG. 5. Bar or beam member 40 passes between and is securely mounted to the inner surfaces of opposing walls 16, 18. Additionally, as seen in FIG. 2, bar 40 includes a sickle type geometric contour. Lower bar section 41 extends in a direction coincident with the extended direction of panel 23 and is positioned to the rear of member 34 to provide a stop for drawer 20 when it is moved into chamber 12. Member 34 is secured to outer face 22 of frontal plate 23 through bolting, welding or some like means. As shown, but not important to the inventive concept, enclosure member 34 is positionally located substantially midpoint between opposing walls 16, 18.

Bar 40 includes opening or bore 44 which is aligned with through passage 46 passing through member 34 in a substantially vertical direction as shown. Through passage 46 having a diameter substantially equal to that of opening 44 defines lateral internal wall 48 of member 34. Recess or wall insert 50 is formed within wall 48 in order to provide a constrainment mechanism between bar member 40 and drawer 20 when locking pin 52 of bar lock 38 is inserted therein.

Bar lock 38, as is shown in FIG. 5, is of standard construction having a locking tube 54 of diameter substantially equal to but slightly smaller than through passage 46 of lock enclosure member 34 to permit insertion therein. Within locking tube 54 there is shown a standard key actuated cylinder lock mechanism 56 having locking pin 52 which is extracted and retracted through an opening in the lateral wall of locking tube 54. When locking pin 52 is retracted into the lateral wall of tube 54, bar lock 38 may be inserted in one piece fashion into through passage 46.

Insertion of bar lock 38 into through passage 46 and extraction of locking pin 52 into recess 50 causes locking tube upper portion 58 to be inserted into bar recess opening 44. In this manner, lock enclosure member 34 is constrained with respect to bar member 40 which in turn is rigidly fixed to oppsoing walls 16, 18 as has been previously described. Further, restrainment of enclosure membr 34 to opposing walls 16, 18 results in drawer mechanism 20 being restrained in a positional location internal to depository 10. Retraction of locking pin 52 from recess 50 conversely releases bar lock 38 from insert or recess 44 and thereby releases drawer 20 from constrainment with respect to the rigid structure components of chest 13. When locking pin 52 is retracted by key actuation of standard cylinder lock 56, the locking pin is moved into but not through the lateral wall of locking tube 54, thereby maintaining cylinder lock 56 in positionally constrained relation to tube 54 while at the same time allowing entire bar lock 38 to be linearly movable with respect to member 34.

Set screw 62 passing through lateral wall 48 of member 34 in conjunction with longitudinally directed recess 66 of locking tube 54 provides a mechanism for maintaining bar lock 38 in slideable securement with respect to lock enclosure member 34. In this manner, bar lock 38 may be retracted from engagement with opening 44 of bar member 40, but still be secured to lock enclosure member 34.

Handle member 68, as is shown in FIGS. 1, 2 and 5 passes over a frontal section of drawer 20. Handle 68 additionally extends across and is securely mounted to outer face 22. Member 68, therefore, provides a partial cover for lock enclosure member 34 as well as providing a mechanism whereby drawer 20 may be pulled external to interior chamber 12. Handle 68 provides protection to releasable securement mechanism 24 from external tampering when mechanism 24 is in a locked or constraining mode of operation. Further, where handle 68 is not rigidly secured to enclosure member 34 along boundary interface 72, it is seen that handle 68 may be pried away or otherwise externally manipulated away from panel 23 without causing mechanism 24 to be removed from constrained relation with respect to rigid bar member 40. Thus, removal of handle 68 will have no causitive effect on the releasability of drawer 20 from constrained positional placement within depository 10.

Inserting mechanism 14 kinematically describes a four bar linkage mechanism which are rotatably mounted to opposing walls 16, 18. Mechanism 14 provides a means whereby objects or articles may be transmitted through gravity assist into drawer 20. Simultaneously, mechanism 14 also provides a means whereby the transmittal passageway to drawer 20 is closed or blocked when mechanism 14 is positionally moved to accept objects to be inserted internal to depository 10. As is clearly seen in FIG. 2, mechanism 14 includes hopper 74 which is rotatably mounted to opposing walls 16, 18 through roller shaft 76. Roller shaft 76 may be mounted stationary with respect to walls 16, 18 and permit hopper 74 to rotate with respect thereto or shaft 76 may be rotatably mounted to walls 16, 18 to provide the necessary rotation of hopper 74. Hopper 74 also includes handle 78 to permit operator actuated rotation of hopper 74 in a direction defined by directional arrowheads 80 shown in FIG. 2. In this manner, hopper 74 may be opened to a first positional location, as shown in phantom lines of FIG. 2, to accept articles inserted therein.

Blocking plate 82 provides another link in the basic four bar likage mechanism defined by mechanism 14. Blocking plate 82 passes substantially between opposing walls 16, 18 and is pivotally mounted thereto through rotatable shaft member 84. Plate member 82 includes a rectangular geometric contour and is rotatable in a plane substantially parallel to planes defined by the surfaces of walls 16, 18 in a direction defined by arrowheads 85. Plate 82 is pivotally mounted to hopper 74 through pivot member or rod 86. Pivot member 86 is pivotally mounted on opposing ends thereof to the sidewalls of hopper 74 at a first pivot point 88 and to plate 82 at a second pivot point 90. As seen in FIG. 2, when hopper 74 is rotated to a first positional location, defined in phantom lines, plate 82 and pivot rod 86 are moved responsive thereto in a rotative path. This movement positionally located plate 82 in direct line with the path of an article passing from hopper 74 into drawer 20. This provides a blocked passageway in order that objects or articles may not be withdrawn from drawer 20 when hopper 74 has been moved to a first positional location as has herein been described. Phantom line drawings of plate 82 and pivot member 86 in FIG. 2 define the blocked pathway into drawer 20 when hopper 74 is in an open position for receiving articles inserted therein.

In this manner, when hopper 74 is rotated to a first positional location, there is then provided an entrance opening 92 where articles may be inserted into hopper 74. Responsive to the movement of hopper 74 to its first positional location, plate 82 is rotatably moved into a position whereby drawer 20 is blocked. When the inserted object is to be transmitted into drawer 20, hopper 74 is rotatively moved to a second positional location defined by the darkened lined drawing of hopper 74 in FIG. 2. Responsive to this movement, plate 82 is moved away from a blocking position in order that the article may pass from exit opening 94 into drawer 20 by gravity assist.

Figure 4:
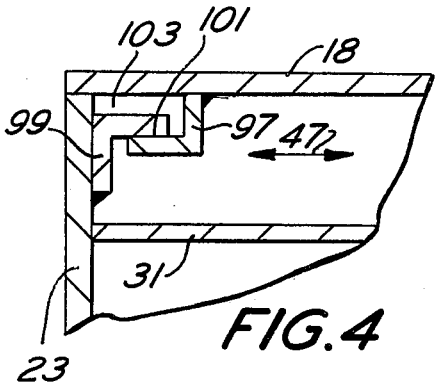
FIG. 4 is a cut-away view of a corner section of the depository drawer taken along the section line 4—4 of FIG. 2.

As is shown in FIG. 4, first angle bar 97 is welded or otherwise fastened to sidewall 18 (another first angle bar 97 is similarly attached to opposing sidewall 16). Second angle bar 99 is welded or otherwise secured to an inner surface of drawer panel 23. As seen in FIG. 2, each of angle bars 97 and 99 extend in a substantially vertical but slightly inclined direction coincident with the inclination of panel 23. Angle bars 97, 99 mate along surface 101 when drawer 20 is directed interior to chamber 12 as is shown. Channel opening 103 is therefore formed to provide an anti-pry mechanism. Where an implement is forced into channel 103 and a torqueing force applied, it is seen that the load is taken up by angle bars 97, 99 and not on drawer sidewall 31.

Upper beam member 45 passes transverse to direction 47 and is secured to opposing sidewalls 16, 18. As seen in FIG. 2 member 45 is constructed to provide a small clearance for insertion mechanism 14 as it is rotated from one position to another. Member 45 is mounted to ceiling 28 through welding or some like technique and prevents removal of material deposited in drawer 20.

An embodiment of the invention is shown in FIGS. 6–10. In this embodiment, depository 10' forming an interior chamber 12' containing drawer mechanism 20' is detailed. Depository 10' defines structural chest 13' having opposing walls 16', 18' in contiguous contact with ceiling and floor members 28', 30' as well as rear wall 32'. Drawer mechanism 20' is partially removable from the interior of chamber 12'. Removal of drawer 20' is facilitated through slideable displacement with respect to track members 104 defining a pair of angle bars mounted at the corners defined by the intersection of opposing walls 16', 18' and floor 30'.

Releasable securement mechanism 24' includes lock enclosure member 34' having therein bar lock 38' as has been previously described. Lock enclosure member 34' is securely fastened to frontal drawer face surface 22' of frontal panel 23' through welding, bolting or some like means. Bar lock 38' is insertable within bar opening 44' as is seen in FIG. 10. Bar member 40' passes between and is securely fastened to opposing walls 16' and 18'. Handle 68', as shown in FIG. 10, extends over lock enclosure member 34' transversely with respect to drawer frontal face 22' to form a partial cover for mechanism 24'. In this manner, drawer 20' is secured to chest structure 13' when bar lock 38' has engaged opening 44' of bar member 40'. Release of bar lock 38' from opening 44' permits slideable removal of drawer 20' from chamber 12'.

Insertion mechanism 14' includes slot 96 formed in frontal wall 23' of drawer 20' as depicted in FIGS. 6, 7 and 8. Articles may be inserted through slot 96 for incorporation into drawer 20'. Additionally, inserting mechanism 14' includes upper and lower appendages 98 which form a passage for articles inserted into drawer 20'. Appendages 98 are rigidly secured to frontal wall inner surface 102 and directed internal to chamber 12' of depository 10'. Appendages 98 pass substantially throughout the transverse length of slot 96. Members 98, as shown in FIG. 9, include a serated edge or undulating teeth 100. In this manner, inserted objects in drawer 20' are protected from removal, since the insertion of an instrument to draw out contained objects would result in the objects being caught on appendage teeth 100.

Further drawer 20' may include a rotatable wall 106 which will permit the opening of drawer 20' after removal from enclosing chest 13'. In this form of the invention, wall 106 is mounted to adjacent drawer sidewall 108 through hinge mechanism 110 shown in FIG. 7. Cam lock 112 engages "L" shaped member 114 which is secured to frontal drawer panel 23'. Cam 116 can be turned to intersect "L" shaped member 114 in a position so as to prevent rotational opening of wall 106. Conversely, standard cam lock 112 may be actuated to rotate cam 116 out of an intersecting path with "L" shaped element 114 to permit opening of drawer 20' by a cashier or other operator when drawer 20' is removed from chest 13'.

What is claimed is:

1. A depository comprising a. a chest defining an interior chamber, b. means for closing said interior chamber to prevent external access to objects deposited in said interior chamber for safekeeping, c. a bar member secured to said chest having a single bore, d. a lock enclosure housing rigidly secured to an outer face of said closing means, said lock enclosure housing having a single through passage aligned with said single bore of said bar member, e. a bar lock movable within said single through passage and having a lock pin insertable into a recess formed in said single through passage when said bar lock is moved within said through passage and inserted into said single bore of said bar member, said bar lock being only movable within said single through passage and said single bore, and f. a portion of said closing means extends external to said outer face of said closing means and provides at least a partial cover for said lock enclosure housing.

2. The depository of claim 1 in which the interface of said bar member and said lock enclosure housing forming forms a plane at an angle to a vertical extension of said chest substantially different from 90°.

3. The depository of claim 2 in which said lock enclosure housing is accessible external of said interior chamber.

4. The depository as recited in claim 3 including means for maintaining said bar lock in slideable securement to said lock enclosure housing when said bar lock is released from said bore formed within said bar member.

5. The depository as recited in claim 1 where said extended portion of said closing means defines handle means secured to opposing ends of said outer face of said closing means, said handle means being displaced with respect to said outer face of said closing means throughout the length of said outer face.

6. The depository as recited in claim 5 where said lock enclosure housing interfaces on a back surface thereof with respect to said outer face of said closing means, said back surface of said lock enclosure housing being rigidly secured to said outer face of said closing means.

7. The depository as recited in claim 1 where said bar member is secured on opposing ends thereof to opposing wall members of said chest, said bar member being secured to an inner surface of each of said wall members.

8. The depository of claim 2 in which said lock enclosure housing has (1) a transverse dimension which is a minor proportion of the transverse dimension of said closing means, and (2) a longitudinal dimension which is a minor proportion of the transverse dimension of said closing means.

* * * * *